US008373638B2

(12) United States Patent
Jang et al.

(10) Patent No.: US 8,373,638 B2
(45) **Date of Patent: *Feb. 12, 2013**

(54) DISPLAY APPARATUS

(75) Inventors: Yong Ho Jang, Seongnam-si (KR); Binn Kim, Seoul (KR); Nam Wook Cho, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 82 days.

This patent is subject to a terminal disclaimer.

(21) Appl. No.: 13/030,853

(22) Filed: Feb. 18, 2011

(65) Prior Publication Data

US 2011/0169874 A1 Jul. 14, 2011

Related U.S. Application Data

(62) Division of application No. 11/471,625, filed on Jun. 21, 2006, now Pat. No. 7,907,113.

(30) Foreign Application Priority Data

Jun. 30, 2005 (KR) ..... 10-2005-0058735

(51) Int. Cl.
*G09G 3/36* (2006.01)

(52) U.S. Cl. ..... 345/100; 345/87; 345/98; 377/64

(58) Field of Classification Search ..... 345/204, 345/100

See application file for complete search history.

(56) References Cited

U.S. PATENT DOCUMENTS

| | | | | |
|---|---|---|---|---|
| 7,038,653 | B2 * | 5/2006 | Moon | 345/100 |
| 7,319,452 | B2 * | 1/2008 | Moon | 345/100 |
| 7,365,722 | B2 * | 4/2008 | Lee | 345/88 |
| 7,907,113 | B2 * | 3/2011 | Jang et al. | 345/100 |
| 8,107,586 | B2 * | 1/2012 | Shin et al. | 377/64 |
| 2004/0174334 | A1 | 9/2004 | Washio et al. | |
| 2004/0217935 | A1 | 11/2004 | Jeon et al. | |
| 2005/0068281 | A1 | 3/2005 | Shin et al. | |

FOREIGN PATENT DOCUMENTS

KR 10-2004-0023241 3/2004

* cited by examiner

*Primary Examiner* — Dorothy Harris
(74) *Attorney, Agent, or Firm* — McKenna Long & Aldridge, LLP

(57) ABSTRACT

A display apparatus is disclosed. The display apparatus includes: a plurality of scan signal lines and a plurality of data signal lines that cross each other; a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix; a scan signal driving circuit including a plurality of stages that supplies the scan signal to the scan signal lines; and a data signal driving circuit that supplies the data signal to the data signal lines, wherein the scan signal driving circuit, the pixels, the scan signal lines and the data signal lines are formed on a same substrate.

3 Claims, 20 Drawing Sheets

DISPLAY APPARATUS

This application is a divisional application of Ser. No. 11/471,625, filed Jun. 21, 2006, now U.S. Pat. No. 7,907,113 now allowed, which claims the benefit of Korean Patent Application No. 10-2005-0058735, filed on Jun. 30, 2005, each of which are hereby incorporated by reference as if fully set forth herein.

BACKGROUND OF THE INVENTION

1. Field of the Invention

The present invention relates to a display apparatus. More particularly, the present invention relates to a display apparatus capable of reducing data signal lines and integrated circuits that drive the data signal lines.

2. Description of the Related Art

A cathode ray tube (CRT) is disadvantageous in its weight and size. Recently, various flat panel display devices have been developed. These flat panel display devices have a reduced weight and a reduced size. A flat panel display device includes a liquid crystal display (LCD), a field emission display (FED), a plasma display panel (PDP), an organic light emitting diode (OLED) display device, etc.

Among these flat panel display devices, the LCD device controls light transmittance of liquid crystal cells according to a video signal to thereby display a picture.

Referring to FIG. 1, an active matrix type LCD includes an LCD panel 13 having (n×m) sub-pixels arranged in a matrix, a gate driving circuit 12, and a data driving circuit 11. Each of the sub-pixels is connected to a thin film transistor (TFT). Each TFT is formed at the crossing parts of n number of gate lines (G1 to Gn) and m number of date lines (D1 to Dm). Herein, n is a positive integer and m is a positive integer. Each TFT is formed to implement any one color of red (R), green (G) and blue (B). The gate driving circuit 12 supplies a scan signal to the gate lines (G1 to Gn) and the data driving circuit 11 supplies a data signal to the data lines (D1 to Dm).

The LCD panel 13 is formed by combining two glass substrates and injecting liquid crystal molecules between the two glass substrates. The gate lines (G1 to Gn) and the data lines (D1 to Dm) are provided at the lower glass substrate of the LCD panel 13 and cross each other perpendicularly. Each TFT provided at a crossing between the pth gate line (Gp) and the qth data line (Dq) applies a data signal supplied via the qth data line (Dq) to the sub-pixel (P[p,q]) located at p row and q column. The supplied data signal is in response to a scan signal from the pth gate line (Gp). Herein, p is a positive integer equal to n or smaller than n and q is a positive integer equal to m or smaller than m. The sub-pixels implement red (R), green (G) and blue (B) colors in response to the data signal. The sub-pixels implementing each of red (R), green (G), and blue(B) colors forms one pixel 15 as shown in FIG. 1. The upper glass substrate of the LCD panel 13 is provided with black matrices, color filters and common electrodes (not shown). A first polarizer having a light axis is attached onto the upper glass substrate of the LCD panel 13 and a second polarizer having a light axis perpendicular to the light axis of the first polarizer is attached onto the lower glass substrate of the LCD panel 13. An alignment film for establishing a free-tilt angle of the liquid crystal is provided at the inner side of at least one of the first and second polarizers tangent to the liquid crystal. Each sub-pixel of the LCD panel 13 is provided with a storage capacitor. Each storage capacitor is provided between the pixel electrode of the sub-pixel and the pre-stage gate line, or between the pixel electrode of the sub-pixel and a common electrode line (not shown). Each storage capacitor enables constantly keeping a voltage of the sub-pixel.

The data driving circuit 11 includes a plurality of data driving integrated circuits. The data driving circuit 11 latches a digital video data, and converts the digital video data into an analog gamma compensation voltage to thereby apply it to the data lines (D1 to Dm).

The gate driving circuit 12 sequentially shifts a start signal every one horizontal period to sequentially apply a scan signal selecting a horizontal line to the gate lines (G1 to Gn).

In addition to the LCD device, flat panel display devices, such as OLED devices, PDP devices, FED devices, etc., also include one pixel organized by sub-pixels that implement red (R), green (G) and blue (B) colors. Each of these display devices includes: scan signal lines to supply a scan signal selecting a horizontal line to each sub-pixel; data signal lines to supply a data signal to each sub-pixel; a scan signal driving circuit that drives the scan signal lines and a data signal driving circuit that drives the data signal lines. In these flat panel display devices, such as in a QVGA device having 320×240 resolution to supply the data signal to each sub-pixel, data signal lines for supplying 320×3 data signals are required. In a VGA device having 640×480 resolution, data signal lines for supplying 640×3 data signals are required. The data signal driving circuit that supplies the data signal to each data signal line includes a number of data signal driving integrated circuits. Accordingly, there is a need to develop schemes that reduce the number of the data signal lines and the number of data signal driving integrated circuits.

SUMMARY OF THE INVENTION

Accordingly, the present invention is directed to a display apparatus that substantially obviates one or more of the problems due to limitations and disadvantages of the related art.

An advantage of the present invention is to provide a display apparatus that reduces the number of data signal lines and the number of data signal driving integrated circuits.

Additional features and advantages of the invention will be set forth in the description which follows, and in part will be apparent from the description, or may be learned by practice of the invention. These and other advantages of the invention will be realized and attained by the apparatus particularly pointed out in the written description and claims hereof as well as the appended drawings.

To achieve these and other advantages and in accordance with the purpose of the present invention, as embodied and broadly described, a display apparatus includes: a plurality of scan signal lines and a plurality of data signal lines that cross each other; a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix; a scan signal driving circuit including a plurality of stages that supplies the scan signal to the scan signal lines; and a data signal driving circuit that supplies the data signal to the data signal lines, wherein the scan signal driving circuit, the pixels, the scan signal lines and the data signal lines are formed on a same substrate.

In another aspect of the present invention, a display apparatus includes: a plurality of scan signal lines and a plurality of data signal lines that cross each other; a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix; a first scan signal driving circuit including (2N−1)th stages that supplies the scan signal to odd-numbered scan signal lines among the scan signal lines, wherein N is a positive integer; a second scan signal driving circuit including (2N)th stages that supplies the scan signal to even-numbered scan signal lines among the scan signal lines; and a data signal driving circuit that supplies the data signal to the data signal lines, wherein the first and the second scan signal driving circuits, the pixels, the scan signal lines and the data signal lines are formed on a same substrate.

In another aspect of the present invention, a display apparatus includes: a plurality of scan signal lines and a plurality of data signal lines that cross each other; a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix; a first scan signal driving circuit including (4M−3)th and (4M−2)th stages that supplies the scan signal to (4M−3)th and (4M−2)th scan signal lines among the scan signal lines, wherein M is a positive integer; a second scan signal driving circuit including (4M−1)th and (4M)th stages that supplies the scan signal to (4M−1)th and (4M)th scan signal lines among the scan signal lines; and a data signal driving circuit that supplies the data signal to the data signal lines, wherein the first and the second scan signal driving circuits, the pixels, the scan signal lines and the data signal lines are formed on a same substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
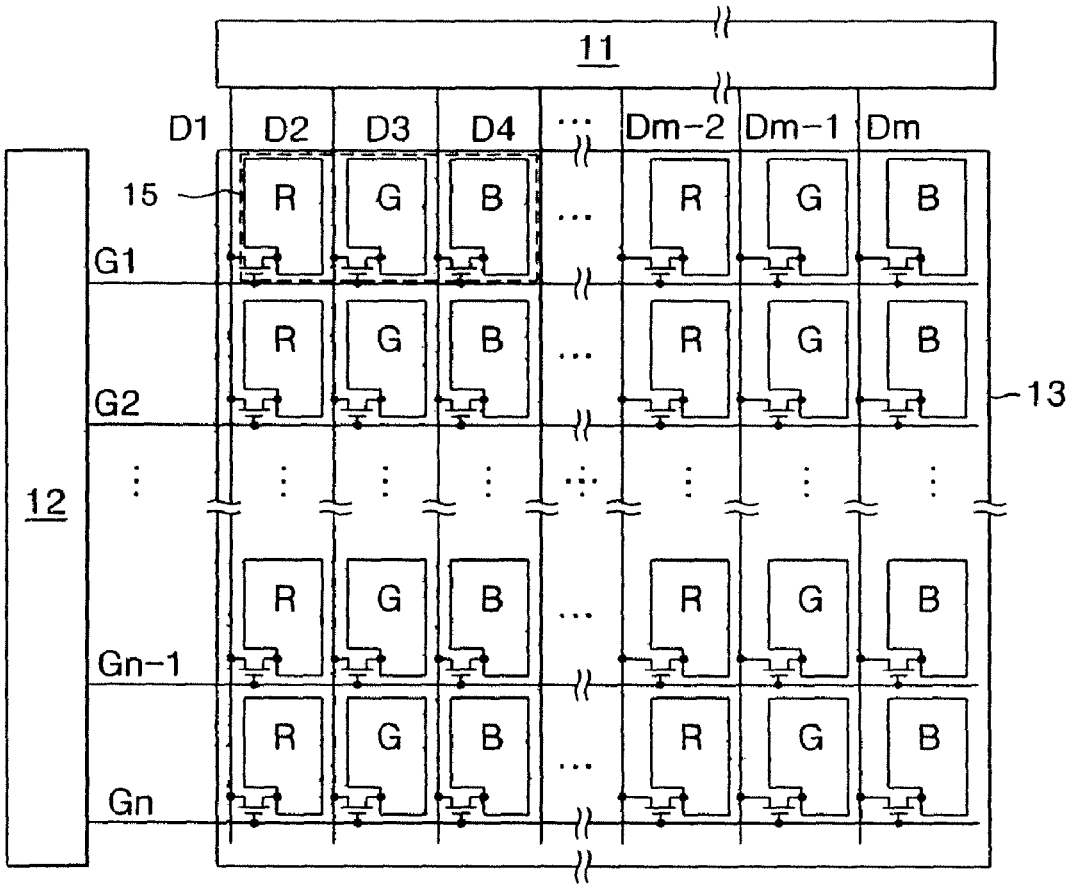
FIG. 1 RELATED ART
FIG. 1 is a view representing a related art liquid crystal display device.
Figure 2:
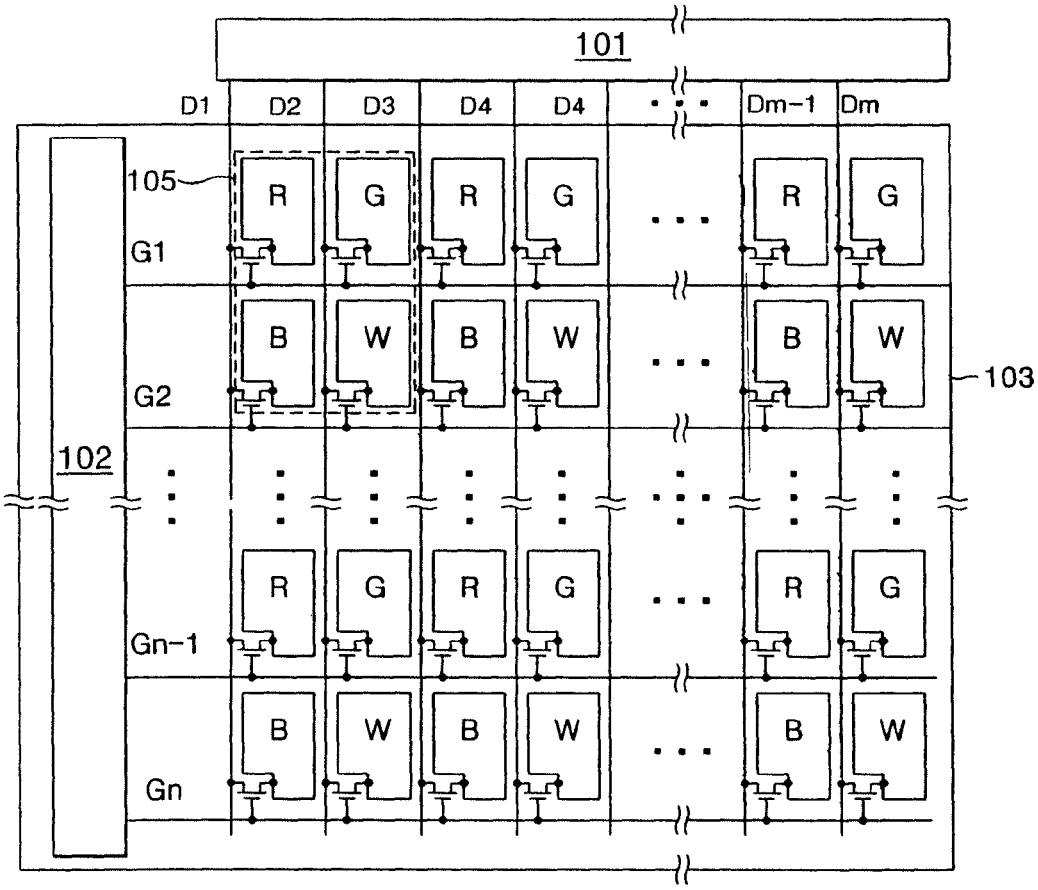
FIG. 2 is a view representing a liquid crystal display device according to an embodiment of the present invention.

FIG. 2 is a view representing a liquid crystal display device according to an embodiment of the present invention.

Referring to FIG. 2, the liquid crystal display (LCD) device according to an embodiment of the present invention includes a LCD panel 103 having (n×m) sub-pixels arranged in a matrix, a gate driving circuit 102, and a data driving circuit 101. Each of the sub-pixels is connected to a thin film transistor (TFT). Each TFT is formed at the crossing parts of n number of gate lines (G1 to Gn) and m number of date lines (D1 to Dm). Herein, n is a positive integer and m is a positive integer. Each TFT is formed to implement any one color of red (R), green (G), blue (B) and white (W). The gate driving circuit 102 supplies a scan signal to the gate lines (G1 to Gn) and the data driving circuit 101 supplies a data signal to the data lines (D1 to Dm).

The LCD panel 103 is formed by combining two glass substrates and providing liquid crystal molecules between the two glass substrates. The gate lines (G1 to Gn) and the data lines (D1 to Dm) are provided at the lower glass substrate of the LCD panel 103 and cross each other substantially perpendicularly. Each TFT provided at a crossing between the ith gate line (Gi) and the jth data line(Dj) applies a data signal supplied via the jth data line (Dj) to the sub-pixel (P[i,j]) located at i row and j column. The supplied data signal is in response to a scanning pulse from the ith gate line (Gi). Herein, i is a positive integer equal to n or smaller than n and j is a positive integer equal to m or smaller than m. The sub-pixels implement red (R), green (G), blue (B) and white (W) colors in response to the data signal. The sub-pixels implementing each of red (R), green (G), blue (B) and white (W) colors form one pixel 105, in a 2×2 matrix quad structure, as shown in FIG. 2. A transparent color filter is used for the white (W) color sub-pixel to enable most of the backlight to exit. Accordingly, brightness is improved. Further, the sub-pixels form one pixel 105, as a 2×2 matrix quad structure, to thereby reduce the number of data lines to ⅓ as compared with the related art LCD device. Accordingly, the number of data driving integrated circuits required in the data driving circuit 101 further becomes reduced. Moreover, the arrangement of the sub-pixels is not limited to such a sequence of red (R), green (G), blue (B) and white (W) colors. The upper glass substrate of the LCD panel 103 is provided with black matrices, color filters and common electrodes (not shown). A first polarizer having a light axis is attached onto the upper glass substrate of the LCD panel 103 and a second polarizer having a light axis perpendicular to the light axis of the first polarizer is attached onto the lower glass substrate of the LCD panel 103. An alignment film for establishing a free-tilt angle of the liquid crystal is provided at the inner side of at least one of the first and second polarizers tangent to the liquid crystal. Each sub-pixel of the LCD panel 103 is provided with a storage capacitor. Each storage capacitor is provided between the pixel electrode of the sub-pixel and the pre-stage gate line, or between the pixel electrode of the sub-pixel and a common electrode line (not shown). Each storage capacitor enables constantly keeping a voltage of the sub-pixel.

On the lower glass substrate of the LCD panel 103, the gate driving circuit 102 that sequentially supplies a scan signal to the gate lines (G1 to Gn) is built-in, as shown in FIG. 2. Such a built-in type gate driving circuit 102 is formed on the lower glass substrate by a chip on glass (COG) system using a plurality of amorphous transistors. The gate driving circuit 102 is simultaneously formed together with the pixel TFT. Accordingly, a separate additional process is not required and the gate driving integrated circuit is not required. It is possible to simplify processes and to thereby reduce processing costs.

The data driving circuit 101 includes a plurality of data driving integrated circuits. The data driving circuit 101 latches digital video data, and converts the digital video data into an analog gamma compensation voltage. This voltage is thereby applied to the data lines (D1 to Dm). The data driving integrated circuits of such a data driving circuit 101 are attached onto the substrate with the aid of a tape carrier package (TCP) as shown in FIG. 2, or are directly mounted on the substrate by a chip on glass (COG) system as shown FIGS. 8 to 10.

Figure 3:
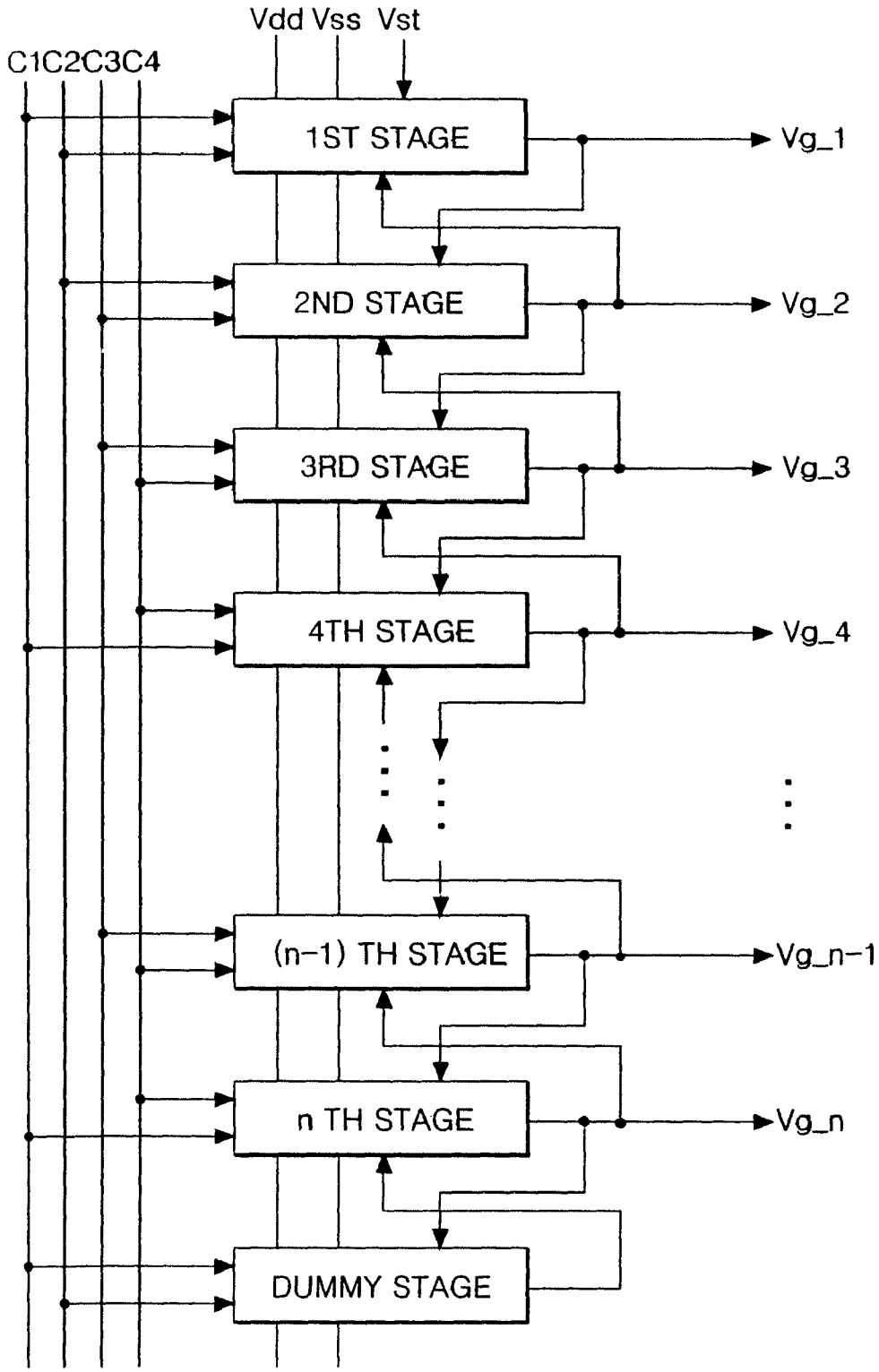
FIG. 3 is a view representing a gate driving circuit shown in FIG. 2.
Figure 4:
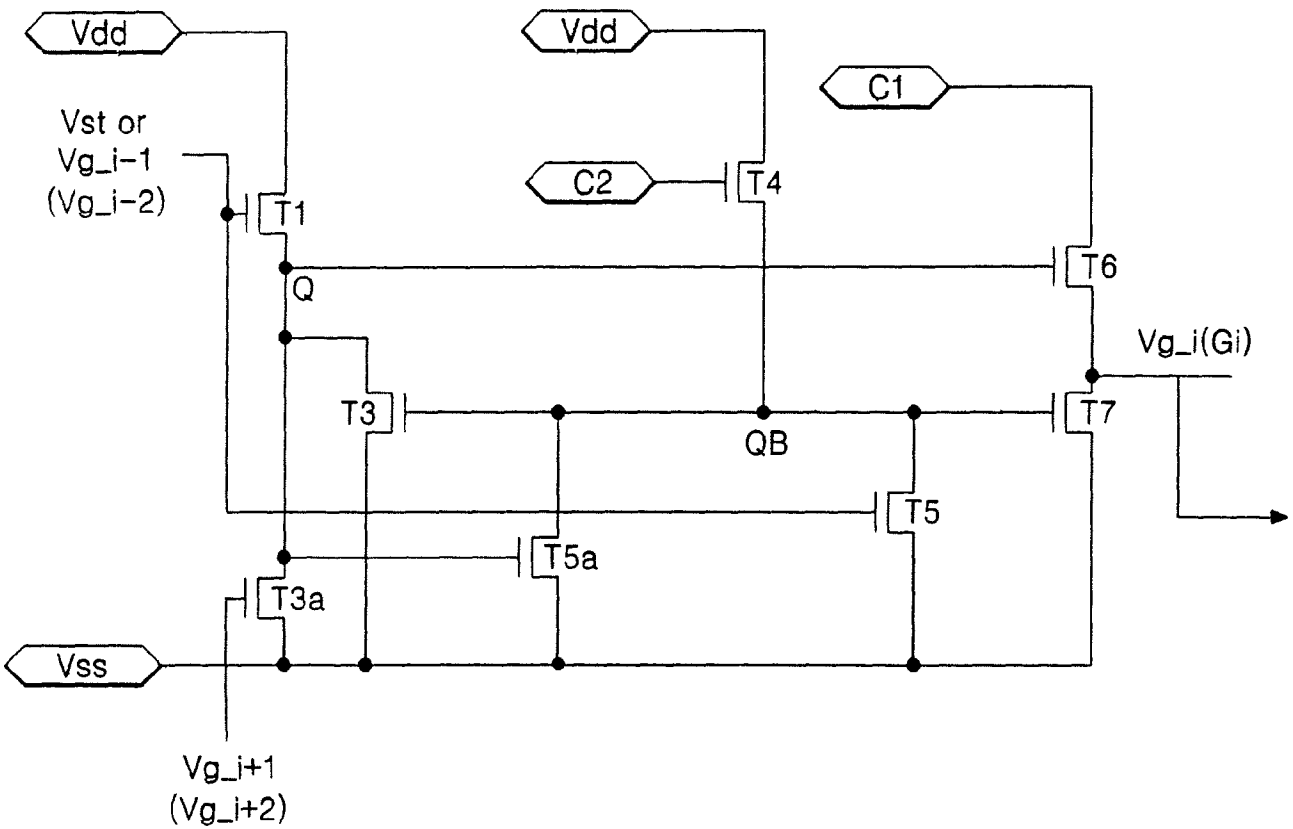
FIG. 4 is a view representing a circuit for each stage of the gate driving circuit shown in FIG. 3.
Figure 5:
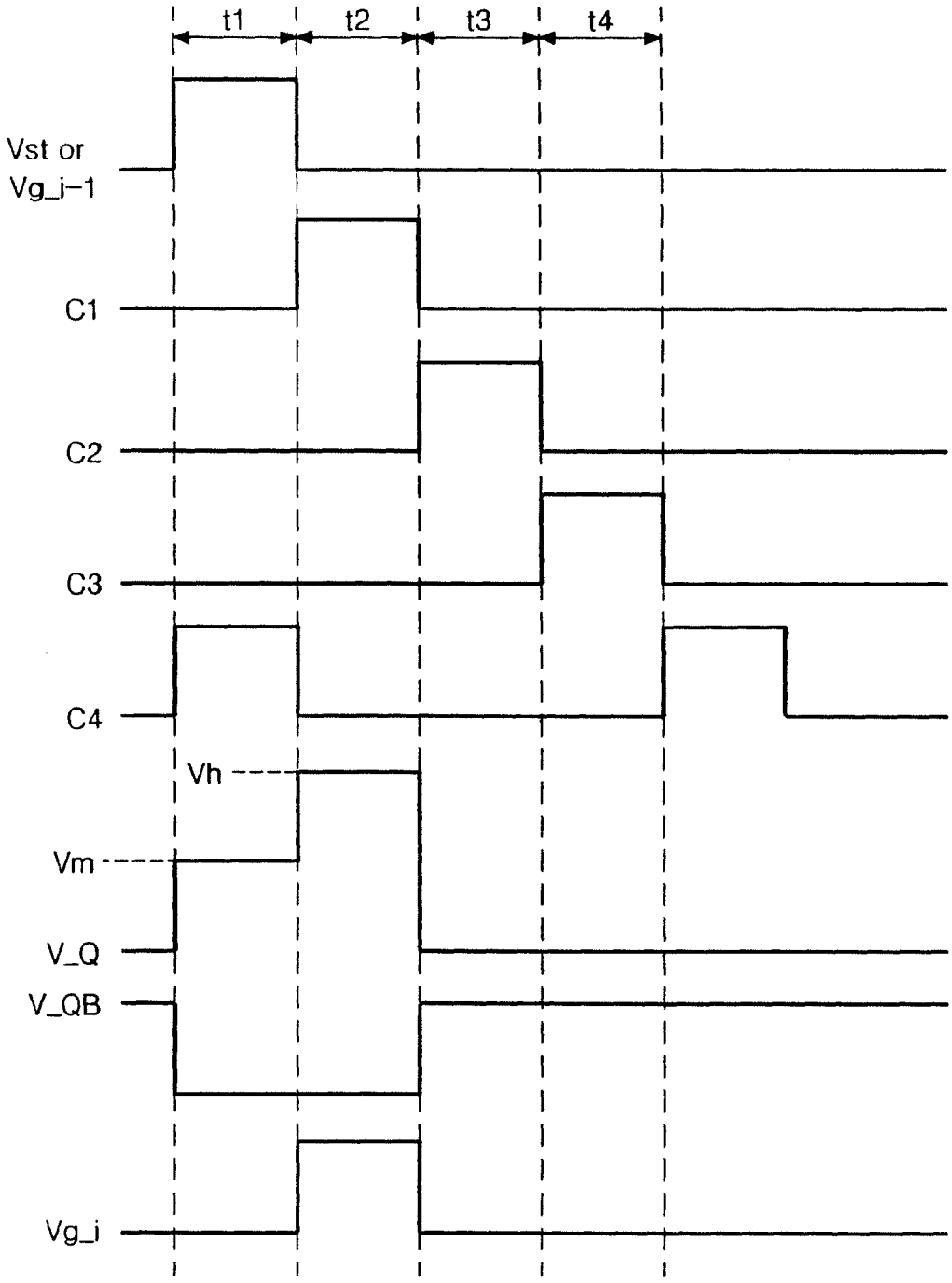
FIG. 5 is a view representing a voltage waveform of each node in the circuit shown in FIG. 4.

FIGS. 3 to 5 show a circuit configuration of the gate driving circuit 102 and each node voltage waveform thereof.

In FIG. 3, the gate driving circuit 102 includes n number of stages connected in a cascading manner. The gate driving circuit 102 also includes a dummy stage. In the gate driving gate circuit 102, a start signal Vst is inputted to the first stage. An output signal Vg_1 of the first stage is inputted as a start signal to the second stage. An output signal Vg_2 of the second stage is inputted as a start signal to the third stage and as a reset signal to the first stage. An output signal Vg_3 of the third stage is inputted as a start signal to the fourth stage and as a reset signal to the second stage. An output signal Vg_4 of the fourth stage is inputted as a start signal to the next stage and as a reset signal to the third stage. This continues until an output signal is inputted as a start signal to the (n−1)th stage and as a reset signal to the (n−3)th stage. An output signal Vg_n−1 of the (n−1)th stage is inputted as a start signal to the nth stage and as a reset signal to the (n−2)th stage. An output signal Vg_n of the nth stage is inputted as a reset signal to the (n−1)th stage. An output signal of the dummy stage is inputted as a reset signal to the nth stage.

Further, each of the stages has the same circuit configuration, and shifts the start signal Vst or the output signals Vg_1 to Vg_n−1 of the previous stages in response to two clock signals of four clock signals C1, C2, C3 and C4. Thereby, a scan signal having a pulse width of one horizontal period is generated.

FIG. 4 shows a detailed circuit configuration of the ith stage in the gate driving circuit 102 shown in FIG. 3. The ith stage includes a sixth transistor T6 for applying a high logical voltage to the ith gate line Gi, and a seventh transistor T7 for applying a low logical voltage to the ith gate line Gi.

An operation of the ith stage, for example the (4k+1)th stage(k is an integer in a range of 0 to n/4) operating in response to the first and the second clock signals, will be described in detail in conjunction with FIG. 5 below.

Referring to FIG. 4 and FIG. 5, during a t1 interval when the first clock signal C1 remains at a low logical voltage, the start signal Vst or the output signal Vg_i−1 of the previous stage having a high logical voltage is applied to the gate electrodes of the first and fifth transistors T1 and T5 to thereby turn on the first and fifth transistors T1 and T5. Then, a voltage V_Q at a first node Q is raised to a middle voltage Vm to turn on the sixth transistor T6, but a voltage Vg_i at the gate line Gi remains at a low logical voltage because the first clock signal C1 remains at a low logical voltage. In this case, the (5*a*)th transistor T5*a* is turned-on by a voltage V_Q on the first node Q.

When the fifth transistor T5 and the (5*a*)th transistor T5*a* are turned on, a voltage at a second node QB is lowered to turn off the third transistor T3 and the seventh transistor T7, thereby shutting off a discharge path of the first node Q.

During a t2 interval, the first clock signal C1 is inverted into a high logical voltage while the start signal Vst or the output signal Vg_i−1 of the previous stage is inverted into a low logical voltage. At this time, the first and fifth transistors T1 and T5 are turned off. Also, the voltage V_Q at the first node Q is added to a voltage charged in a parasitic capacitor between the drain electrode and the gate electrode of the sixth transistor T6 that is supplied with a high logical voltage of the first clock signal C1. Thus, the voltage V_Q is thereby raised into more than a threshold voltage of the sixth transistor T6. In other words, the voltage V_Q at the first node Q rises to a higher voltage Vh than that in the t1 interval by bootstrapping. Thus, during the t2 interval, the sixth transistor T6 is turned on, and a voltage Vg_i at the ith gate line Gi rises with the aid of the voltage of the first clock signal C1 supplied by a conduction of the sixth transistor T6 that is inverted into a high logical voltage.

During a t3 interval, the first clock signal C1 is inverted into a low logical voltage while the second clock signal C2 is inverted into a high logical voltage. At this time, the fourth transistor T4 is turned-on in response to the second clock signal C2 and a high potential power voltage Vdd is applied, via the fourth transistor T4, to the second node QB to thereby raise a voltage V_QB at the second node QB. The raised voltage V_QB at the second node QB turns on the seventh transistor T7 to discharge the voltage Vg_i at the ith gate line Gi into a ground voltage Vss, and, at the same time, turns on the third transistor T3 and a (3*a*)th transistor T3*a* to discharge the voltage V_Q at the first node Q into the ground voltage Vss.

During a t4 interval, if the second clock signal C2 is inverted into a low logical voltage, then the fourth transistor T4 is turned off. At this time, a high logical voltage is floated at the second node QB. A high logical voltage at the second node QB is kept during the remaining frame interval.

Figure 6:
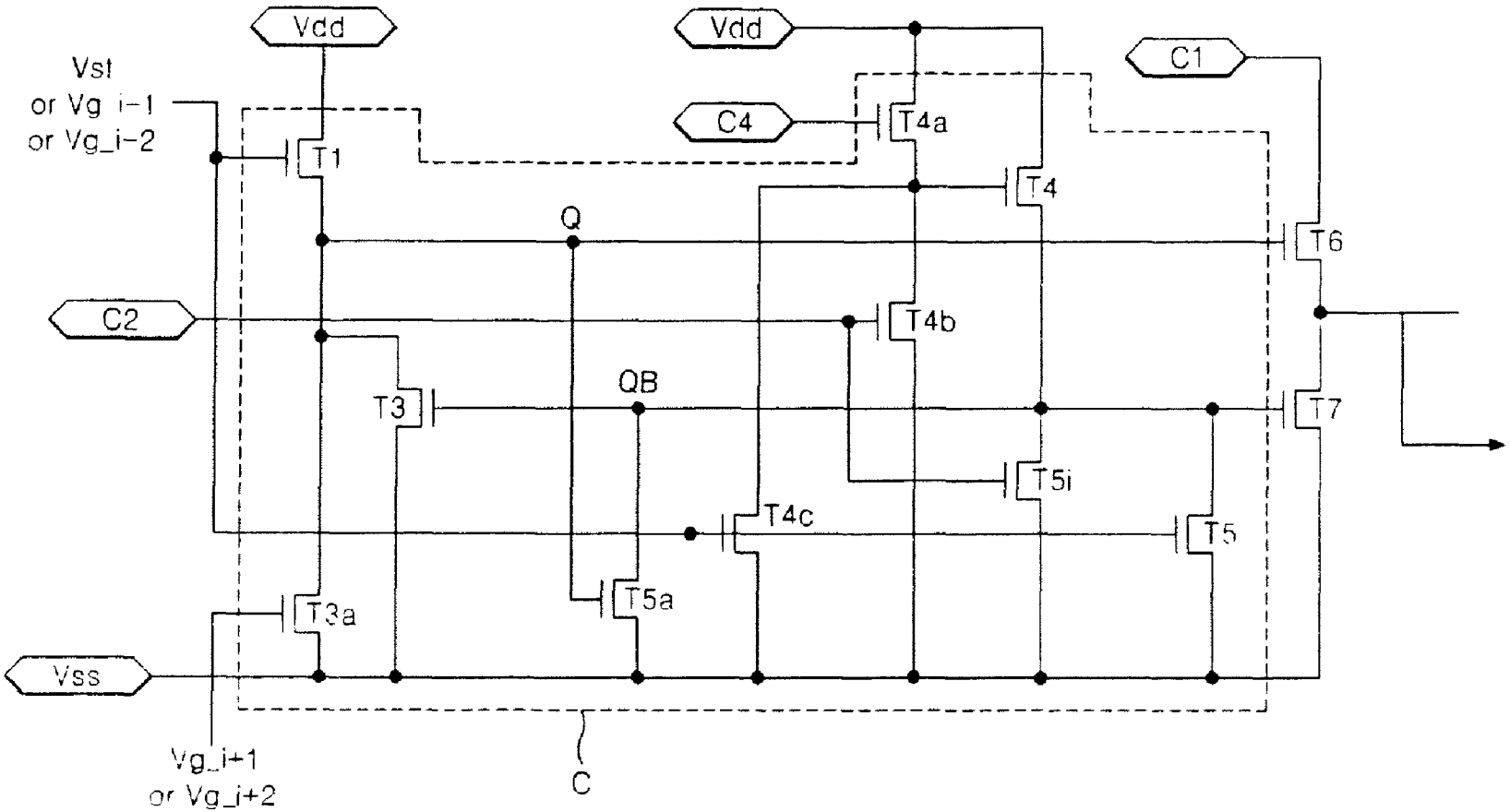
FIG. 6 is a view representing another circuit for each stage of the gate driving circuit shown in FIG. 3.

FIG. 6 is a view representing another circuit for the ith stage of the gate driving circuit 102 shown in FIG. 3. The circuit maintains the voltage at the QB node at the high state in a clock timing in which the output signal Vg−1 is generated by using one QB node. Thereby, a deterioration of a pull-down part is prevented. The circuit represents the same efficiency as a cross-driving system by using two QB nodes every frame and has an advantage in that it is possible to largely reduce a circuit size.

An operation of the circuit will be described in detail in conjunction with FIG. 7 which represents each node voltage waveform of the circuit shown in FIG. 6.

Figure 7:
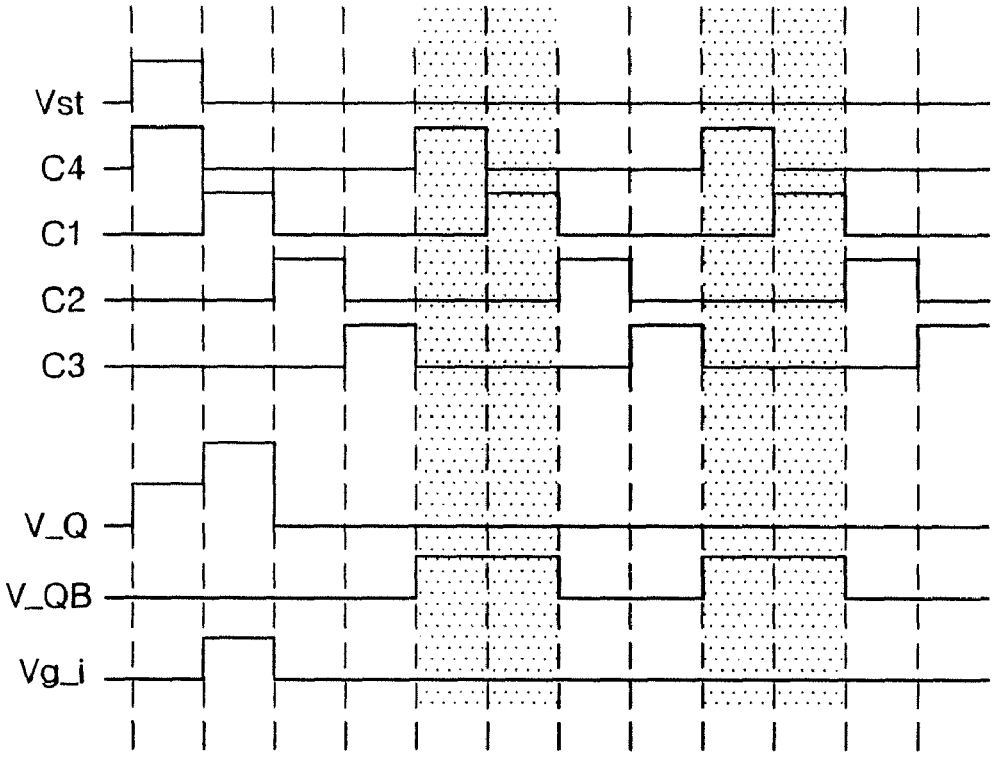
FIG. 7 is a view representing a voltage waveform of each node in the circuit shown in FIG. 6.

Referring to FIG. 6 and FIG. 7, the first stage includes an output buffer having a pull-up transistor T6 for outputting a first clock signal C1 to a first gate line G1 under control of a Q-node. The first stage also includes a pull-down transistor T7 for outputting a low potential power voltage $V_{SS}$ to the first gate line G1 under control of a QB node. The first stage also includes a controller having first to (5*i*)th transistors T1 to T5*i* for controlling the Q-node and the QB-node. Such a first stage is supplied with a high electrical potential power voltage $V_{DD}$, a low electrical potential power voltage $V_{SS}$ and a start signal Vst, with the first, the second and the fourth clock signals C1, C2 and C4. The phases of these clock signals are different from each other as shown in FIG. 7. Hereinafter, an operation procedure of the first stage will be described with reference to a driving waveform shown in FIG. 9.

Referring to FIG. 7, during a t1 interval, the first transistor T1 is turned on by high voltage of the start signal Vst to thereby pre-charge the high voltage of the start signal Vst into the Q-node. The pull-up transistor T6 is turned on by a high voltage pre-charged into the Q-node to thereby supply a low voltage of the first clock signal C1 as an output signal Vg_1 to the first gate line G1. At this time, the QB-node becomes a low voltage state by the fifth transistor T5 turned on by a high voltage of the start signal Vst and the (5*a*)th transistor T5*a* turned on by a high voltage of the Q node, so that the third transistor T3 and the pull-down transistor T7 are turned off Meanwhile, the (4*a*)th transistor T4*a* is turned on by the fourth clock signal C4, but a low voltage of a low electrical potential power voltage Vss is supplied from the (4*c*)th transistor T4*c* turned on by the start signal Vst to turn off the fourth transistor T4 thereby shutting off a charge path of the QB-node.

During a t2 interval, the first transistor T1 is turned off by a low voltage of the start signal Vst, so that the Q-node is floated into a high voltage state while the pull-up transistor T6 keeps a turn-on state. At this time, by a high voltage of the first clock signal C1, the Q-node is bootstrapped due to a parasitic capacitor formed by an overlap between the gate electrode and the drain electrode of the pull-up transistor T6. Thus, the Q-node voltage is charged having the higher voltage than that of the Q-node voltage in the t1 interval. Accordingly, the pull-up transistor T6 is turned on, thereby rapidly supplying a high voltage of the first clock signal C1 as an output signal Vg_1 to the first gate line G1. Also, the QB-node discharged via the (5*a*)th transistor T5*a* is turned on by the Q-node maintaining a low voltage state.

During a t3 interval, the (3*a*) transistor T3*a* is turned on by a high voltage of a gate output signal Vg_2 of the next stage, and the (4*b*)th and the (5*i*)th transistors T4*b* and T5*i* are turned on by a high voltage of the second clock signal C2. The Q-node is supplied with a low voltage of a low electrical potential power voltage Vss via the turned-on (3*a*)th transistor T3*a* to turn off the pull-up transistor T6. The QB-node is supplied with a low voltage of a low electrical potential power voltage Vss via the turned-on (5*i*)th transistor T5*i* to maintain the low voltage state. At this time, the fourth transistor T4 shuts off when a high voltage is supplied to the QB-node while maintaining the turn-off state through the turned-on (4*b*)th transistor T4*b*. Meanwhile, as the t3 interval starts, the Q-node is perfectly discharged. Accordingly, the output signal Vg_1, maintaining the high state during the t2 interval caused by the first clock signal C1, is discharged before the pull-up transistor T6 is turned-on. Thereby, although the pull-up and the pull-down transistor T6 and T7 have a turned-off state due to the Q-node and the QB-node, the output signal Vg_1 maintains the low voltage state.

During a t4 interval, all of transistors are turned off to make the QB-node and the output signal Vg_1 float with the voltage state.

During a t5 interval, the fourth clock signal C4 is inverted to a high voltage to turn on the (4*a*)th and the fourth transistors T4*a* and T4, thereby supplying the high voltage to the QB-node. Accordingly, the third and the pull-down transistors T3 and T7 are turned-on by the QB-node. At this time, a low electrical potential power voltage Vss is supplied via the third transistor T3 to the Q node, so that the Q node maintains the low voltage state. And the low voltage of the low electrical potential power voltage Vss as an output signal Vg_1 is supplied via the pull-down transistor T7 to the first gate line G1.

During a t6 interval, the fourth clock signal C4 is again inverted to the low voltage, but a discharge path of the QB-node entirely maintains the shut-off state, so that the QB-node is continually floated with the high voltage state. By the high voltage of the QB-node, the third and the pull-down transistors T3 and T7 are turned-on, and the Q node and the output signal Vg_1 maintains the low state as described above in the t5 interval.

During a t7 interval, the second clock signal C2 is inverted to a high voltage, to turn-on the (4*b*)th and the (5*i*)th transistors T4*b* and T5*i*. The fourth transistor T4 maintains the turn-off state caused by the (4*b*)th transistor to shut off the high voltage supplied to the QB-node. The (5*i*)th transistor T5*i* supplies a low electrical power voltage Vss to the QB-node to make the QB-node maintain the low voltage state. Meanwhile, the Q-node is floated to the low voltage of the T6 interval. As both of the Q-node and the QB-node maintain the low voltage, both of the pull-up and the pull-down transistors are turned off. Accordingly, the output signal Vg_1 is floated with the low voltage state.

During a t8 interval, the transistors are turned off, so that the Q-node, the QB-node and the output signal Vg_1 maintain the low state same as in the t4 interval. The first stage repeats the state of the t4 interval to the t7 interval to maintain the state until after the t8 interval to a time when the appropriate frame is finished.

As mentioned above, the gate driving circuit 102 according to FIG. 6 maintains the QB node with the high voltage state in a clock timing when the high voltage signal is outputted by using one QB node. Accordingly, it represents the same efficiency as a cross-driving system by using two QB nodes every frame and has an advantage in that it is possible to largely reduce the circuit size.

Meanwhile, a system which drives gate lines in both directions by dividing a gate driving circuit into two is possible in the present invention. Also, a system which drives the gate lines in one direction by one built-in gate driving circuit with aid of the circuit of FIG. 4 or FIG. 6 is possible in the present invention.

Figure 8:
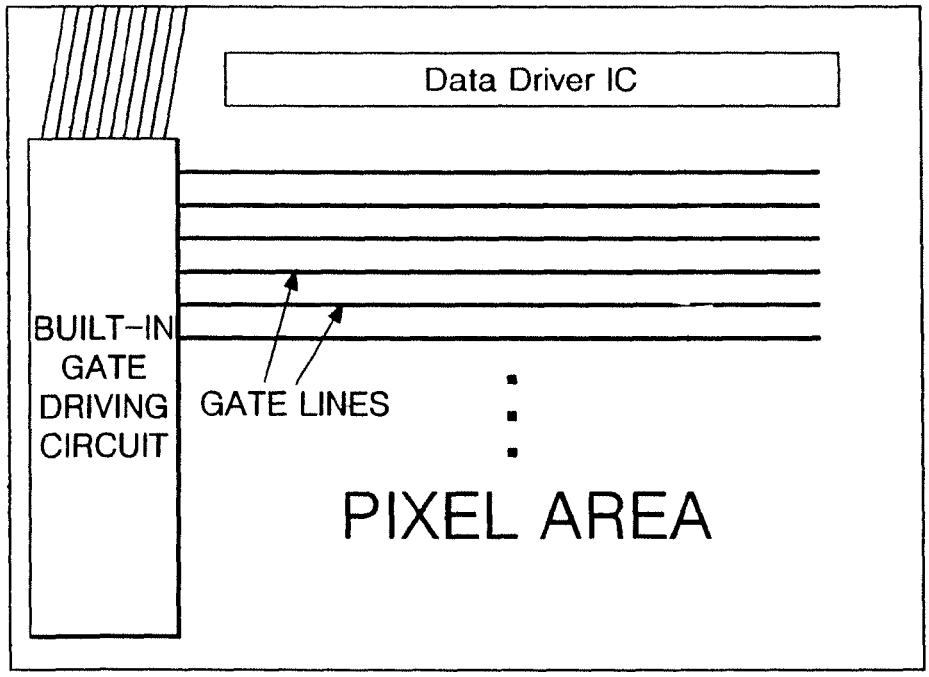
FIG. 8 is a view representing a liquid crystal display device including a built-in gate driving circuit driving a gate line at one direction according to an embodiment of the present invention.
Figure 9:
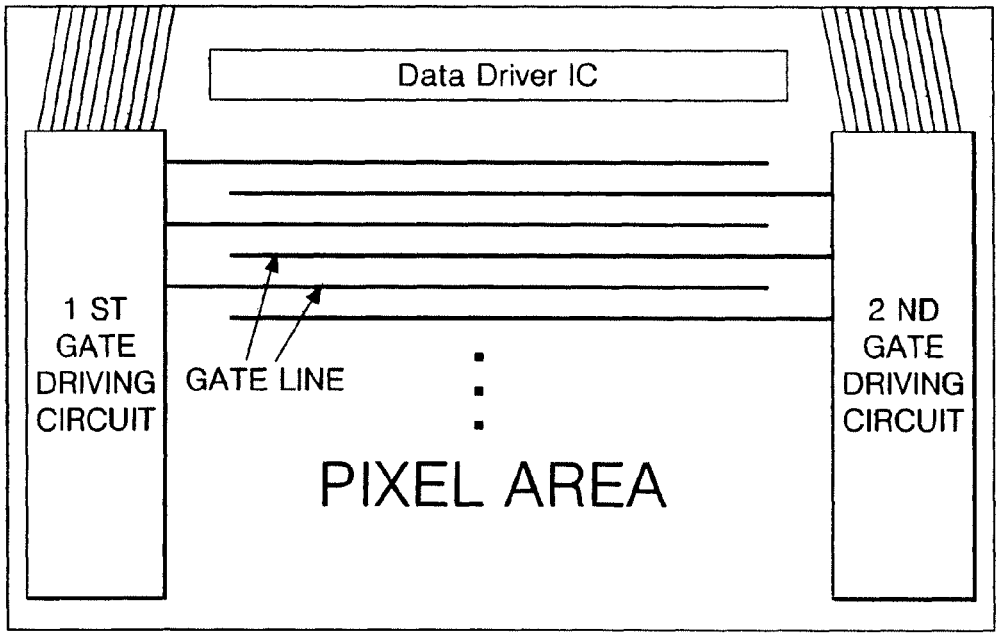
FIG. 9 is a view representing a liquid crystal display device including a built-in gate driving circuit driving a gate line at both directions according to an embodiment of the present invention.
Figure 10:
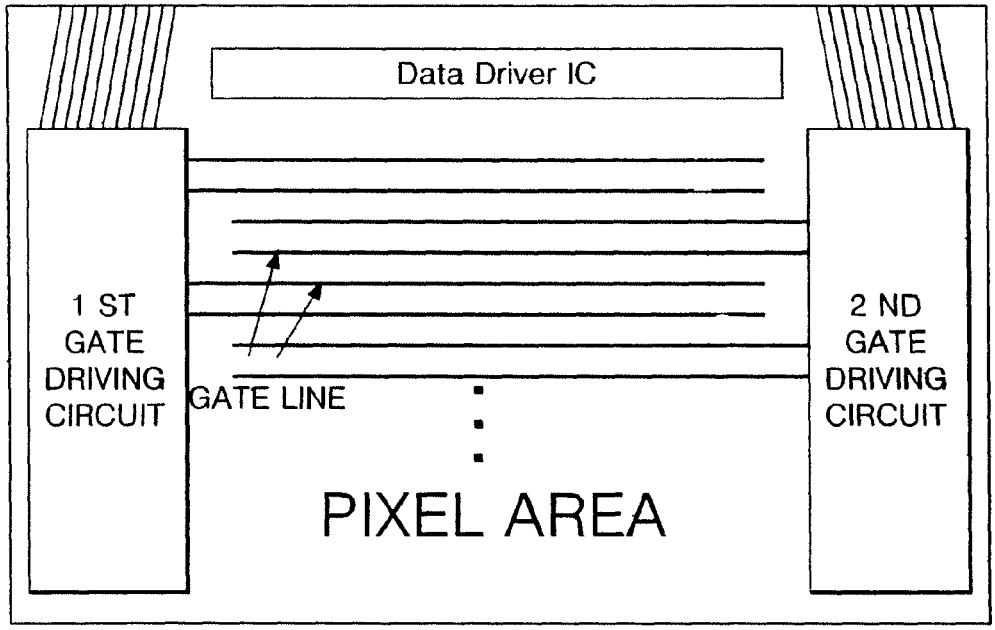
FIG. 10 is a view representing a liquid crystal display device including another built-in gate driving circuit driving a gate line at both directions according to an embodiment of the present invention.

FIG. 8 represents the system which drives the gate lines G1 to Gn by one gate driving circuit in one direction, and FIG. 9 represents the system which drives the gate lines in both directions by dividing a stage of the gate driving circuit into a first gate driving circuit having an odd numbered stage and a second gate driving circuit having an even numbered stage. As shown in FIG. 10, a system, which drives the gate lines in both directions by dividing a first gate driving circuit having the (4*s*−3)th and the (4*s*−2)th stages and a second gate driving circuit having the (4*s*−1)th and the (4*s*)th stages, is possible. Herein, s is a positive integer equal to n/4 or smaller than n/4.

FIGS. 11 to 18 represent a configuration of a stage for implementing the system of FIG. 9 by using the circuit of FIG. 4 or FIG. 6.

Referring to FIGS. 11 to 18, a first gate driving circuit includes odd-numbered stages for driving odd-numbered gate lines, and a second gate driving circuit includes even-numbered stages for driving even-numbered gate lines. FIGS. 11, 12, 13 and 14 represent an implement, using the circuit of FIG. 4, of the system of FIG. 9, and FIGS. 15, 16, 17 and 18 represent an implement, using the circuit of FIG. 6, of the system of FIG. 9.

Figure 11:
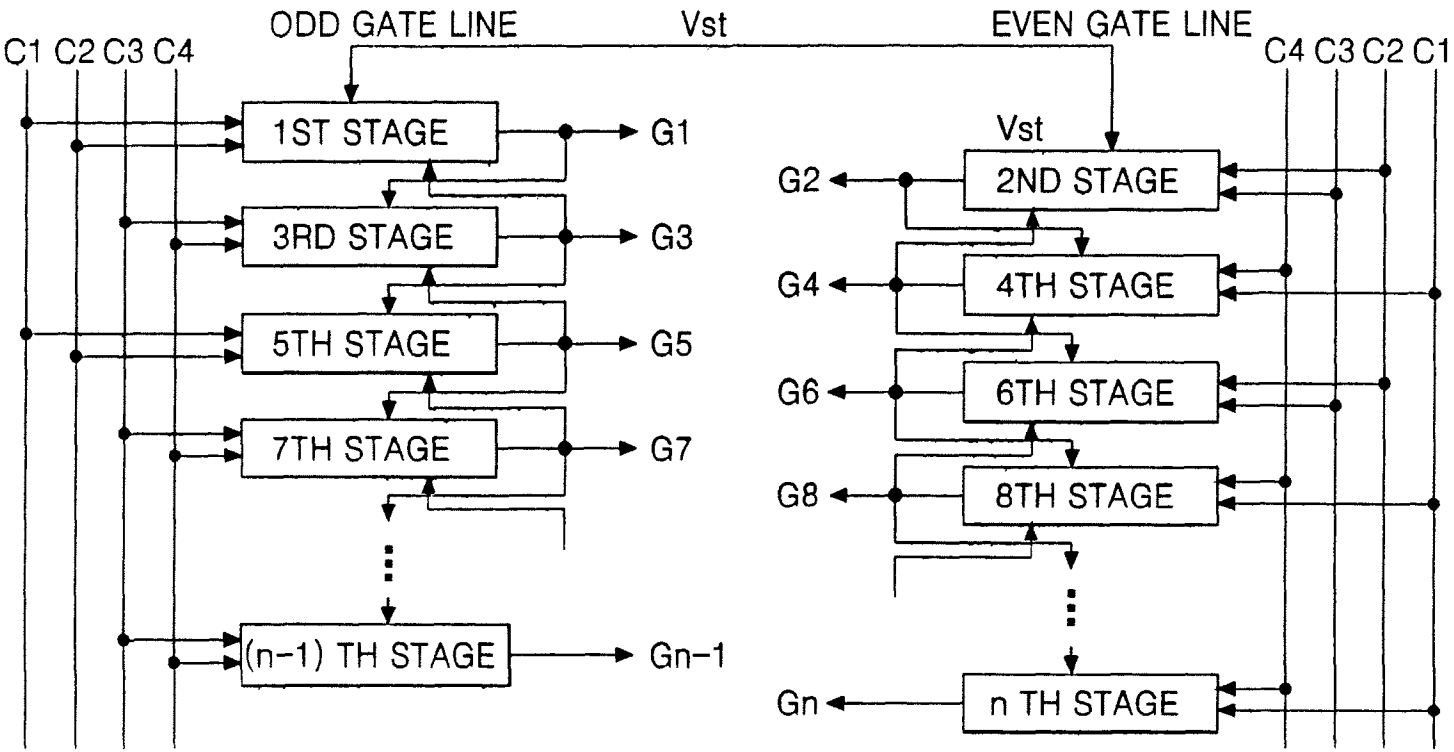
FIG. 11 is a view representing an implement of the gate driving circuit shown in FIG. 9, using the circuit of FIG. 4.
Figure 15:
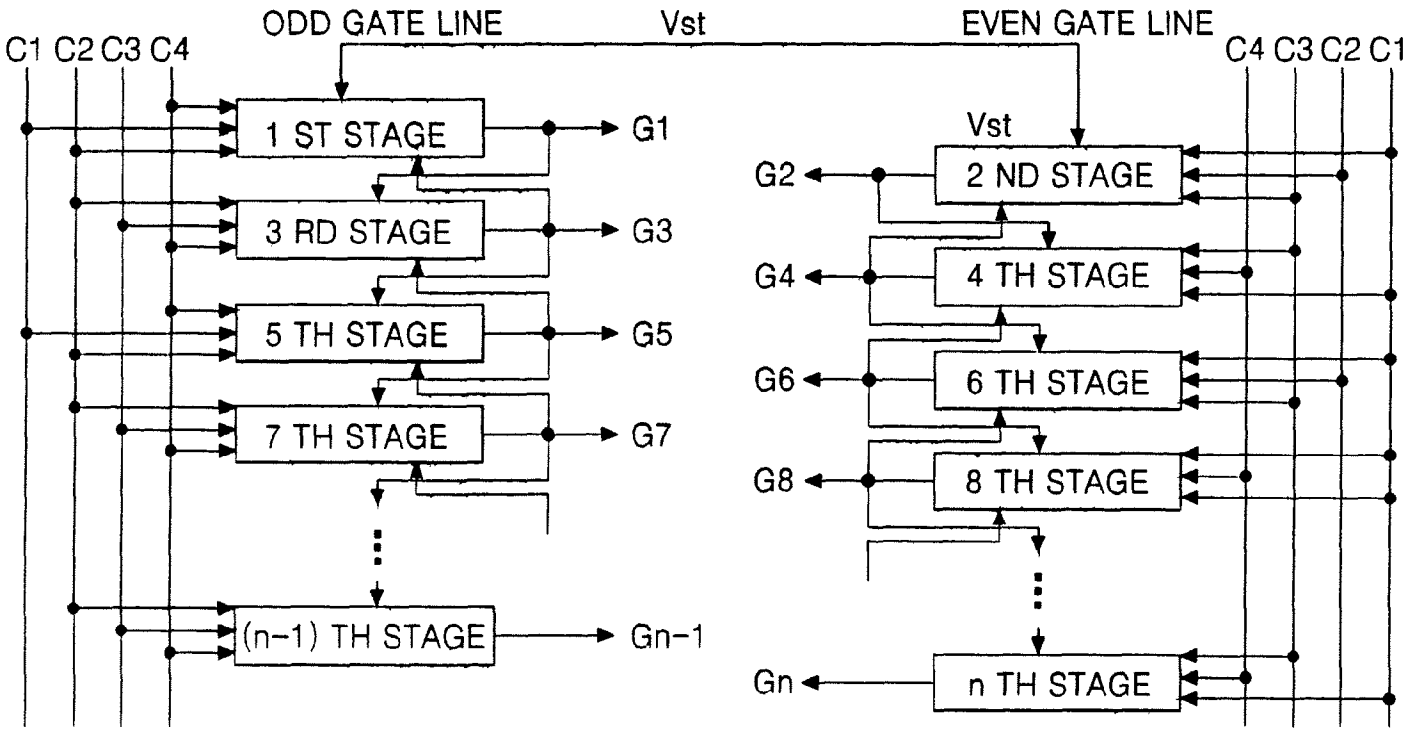
FIG. 15 is a view representing an implement of the gate driving circuit shown in FIG. 9, using the circuit of FIG. 6.

FIG. 11, FIG. 12, FIG. 15 and FIG. 16 represent a method in which a start signal of an odd-numbered terminal is received from an odd-numbered terminal and a start signal of an even-numbered terminal is received from an even-numbered terminal. For instance, an output of a first terminal is used as a start signal of a third terminal, the output of the third terminal is used as a start signal of a fifth terminal, an output of a second terminal is used as a start signal of a fourth terminal, and the output of the fourth terminal is used as a start signal of a sixth terminal, etc. FIG. 11 and FIG. 15 differ from FIG. 12 and FIG. 16 in a method of receiving a reset signal, as discussed below.

FIG. 11 and FIG. 15 represent a method in which an output of a third terminal is used as a reset signal of a first terminal, an output of a fifth terminal is used as a reset signal of a third terminal, an output of a fourth terminal is used as a reset signal of a second terminal, and an output of a sixth terminal is used as a reset signal of a fourth terminal.

Figure 12:
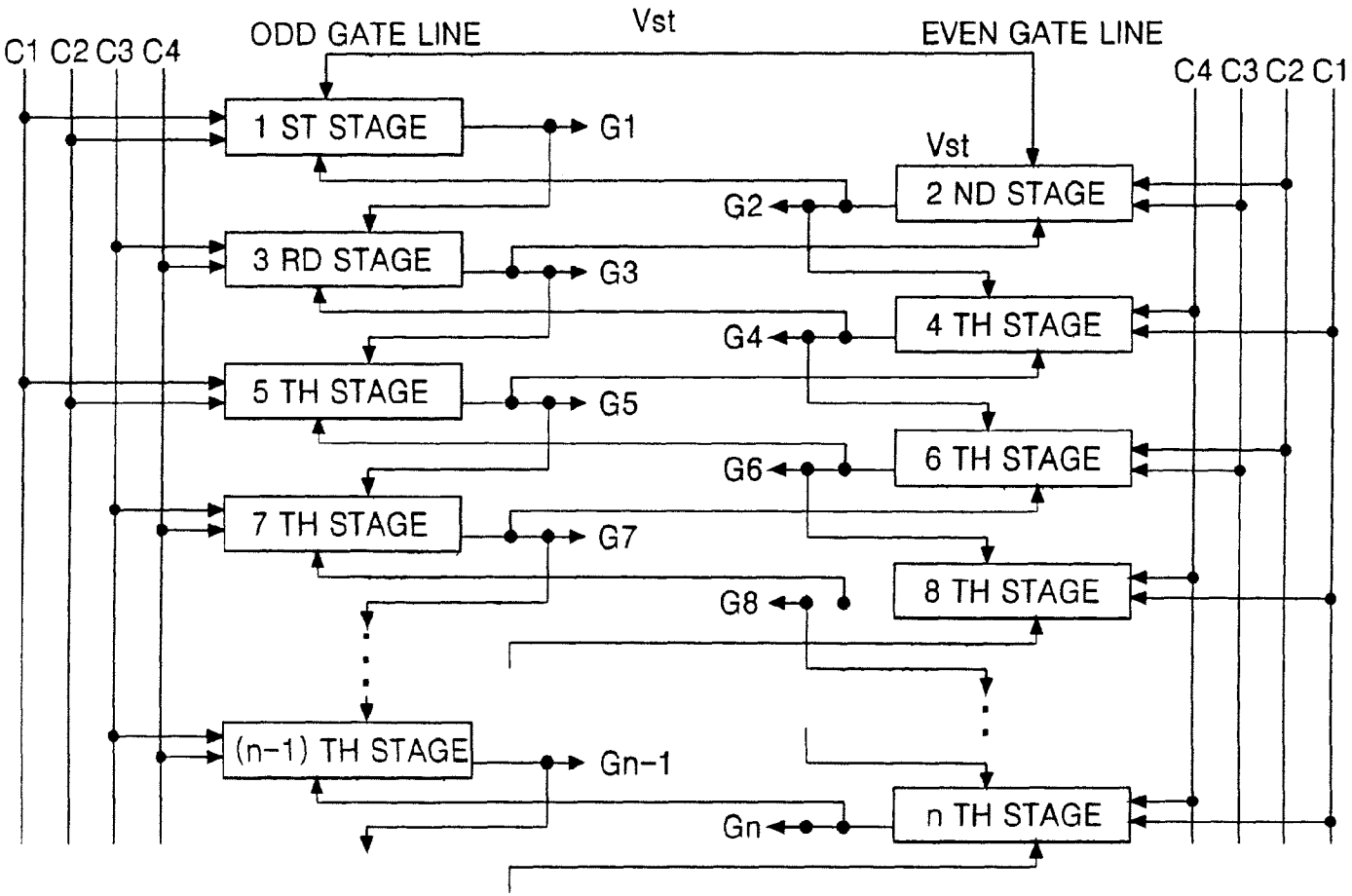
FIG. 12 is a view representing another implement of the gate driving circuit shown in FIG. 9, using the circuit of FIG. 4.
Figure 16:
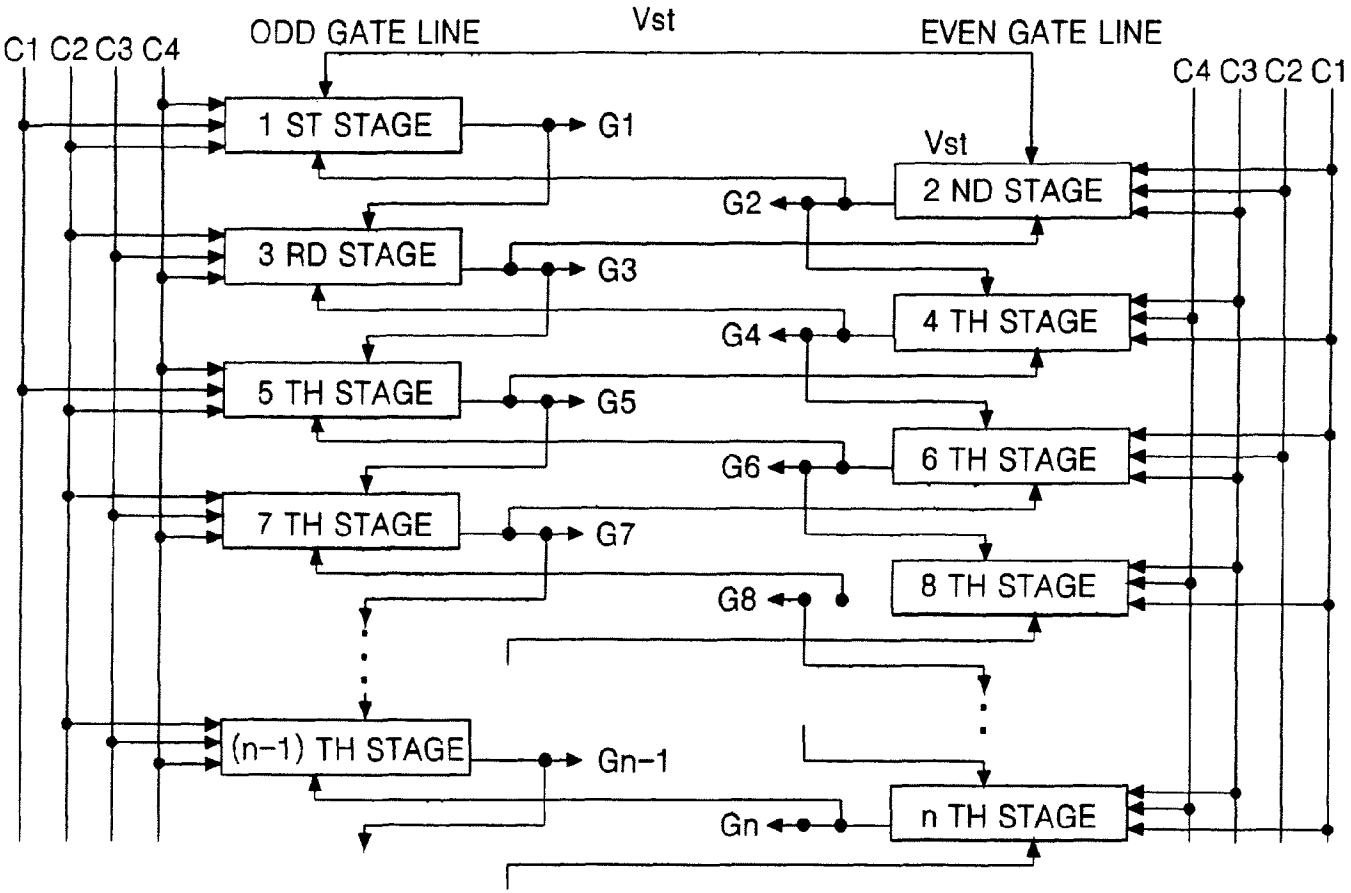
FIG. 16 is a view representing another implement of the gate driving circuit shown in FIG. 9, using the circuit of FIG. 6.

On the other hand, FIG. 12 and FIG. 16 represent a method in which an output of a second terminal is used as a reset signal of a first terminal, an output of a third terminal is used as a reset signal of a second terminal, an output of a fourth terminal is used as a reset signal of a third terminal, and an output of a fifth terminal is used as a reset signal of a fourth terminal.

Figure 13:
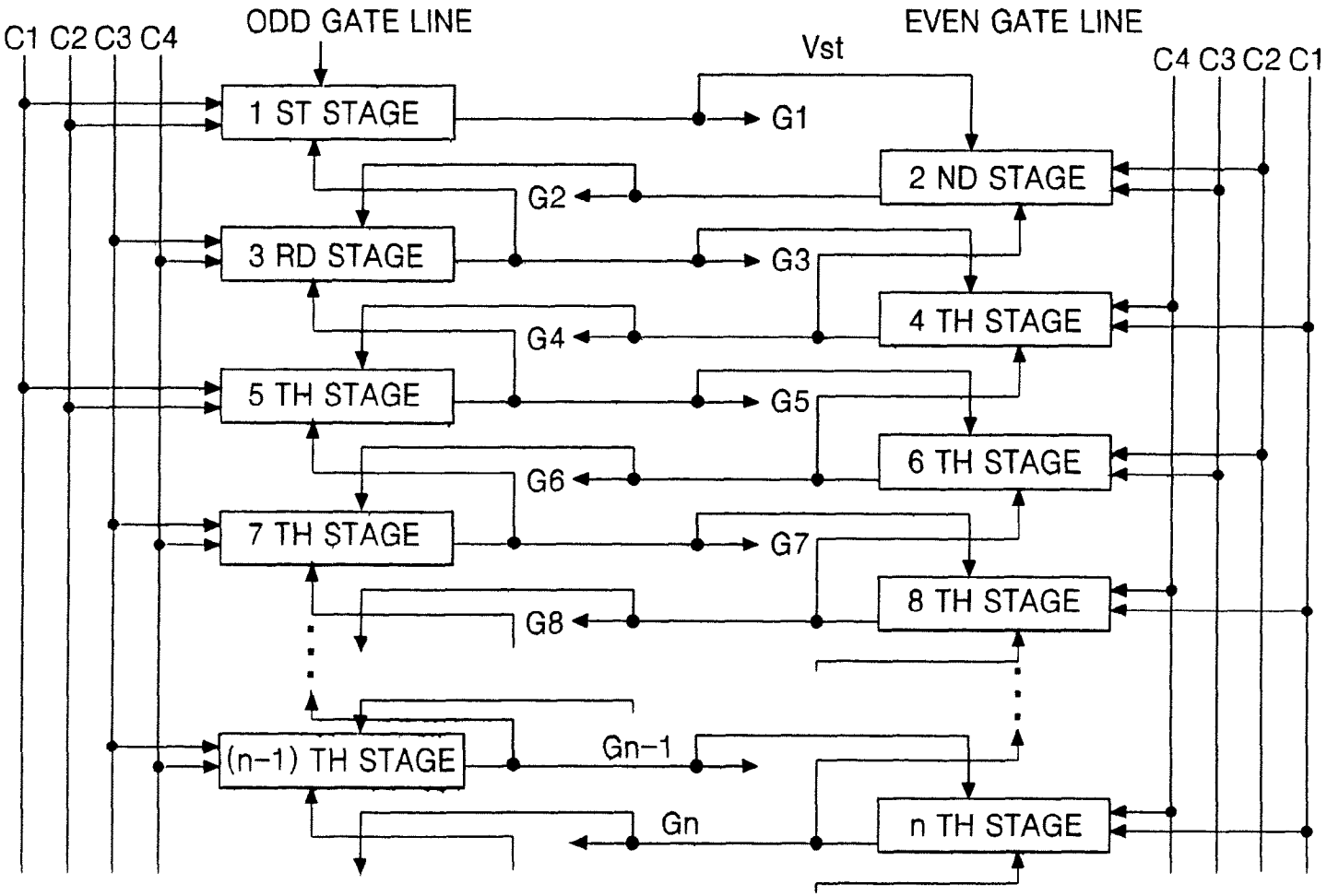
FIG. 13 is a view representing still another implement of the gate driving circuit shown in FIG. 9, using the circuit of FIG. 4.
Figure 17:
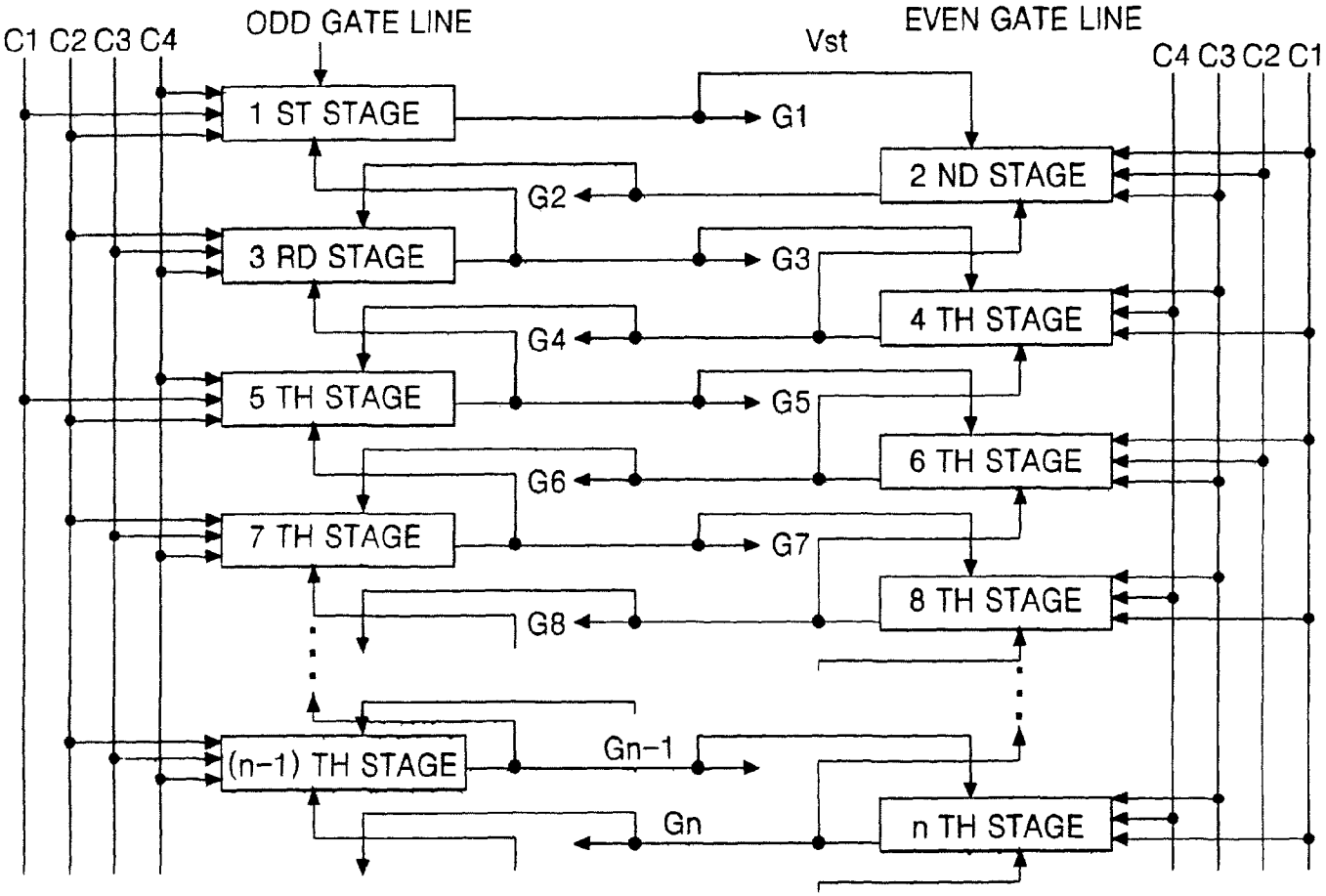
FIG. 17 is a view representing still another implement of the gate driving circuit shown in FIG. 9, using the circuit of FIG. 6.

FIG. 13, FIG. 14, FIG. 17 and FIG. 18 represent a method in which an output of a first terminal is used as a start signal of a second terminal, the output of the second terminal is used as a start signal of a third terminal, an output of a third terminal is used as a start signal of a fourth terminal, and the output of the fourth terminal is used as a start signal of a fifth terminal, etc. FIG. 13 and FIG. 17 differ from FIG. 14 and FIG. 18 in a method of receiving a reset signal, as discussed below.

FIG. 13 and FIG. 17 represent a method in which an output of a third terminal is used as a reset signal of a first terminal, an output of a fifth terminal is used as a reset signal of a third terminal, an output of a fourth terminal is used as a reset signal of a second terminal, and an output of a sixth terminal is used as a reset signal of a fourth terminal.

Figure 14:
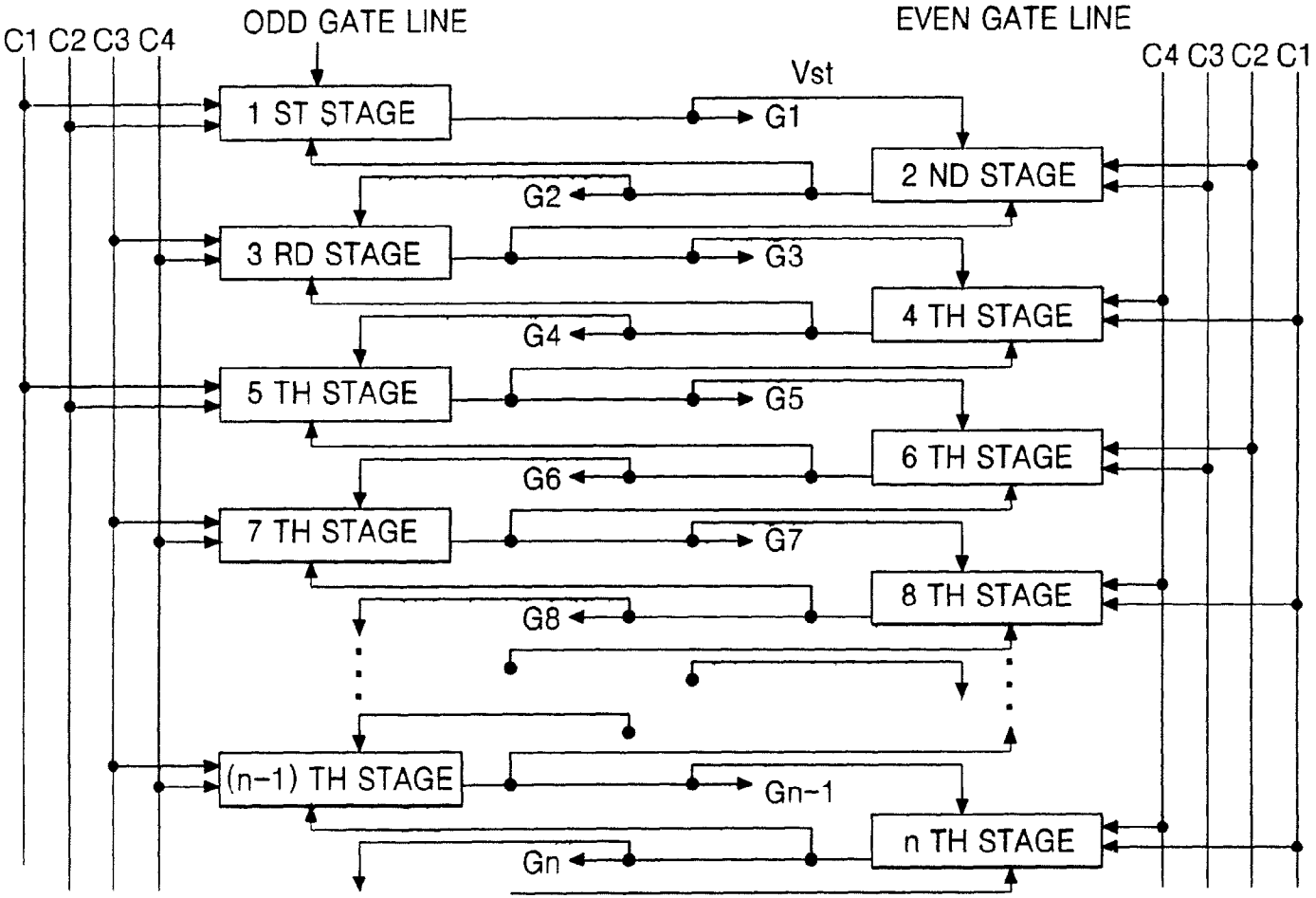
FIG. 14 is a view representing still another implement of the gate driving circuit shown in FIG. 9, using the circuit of FIG. 4.
Figure 18:
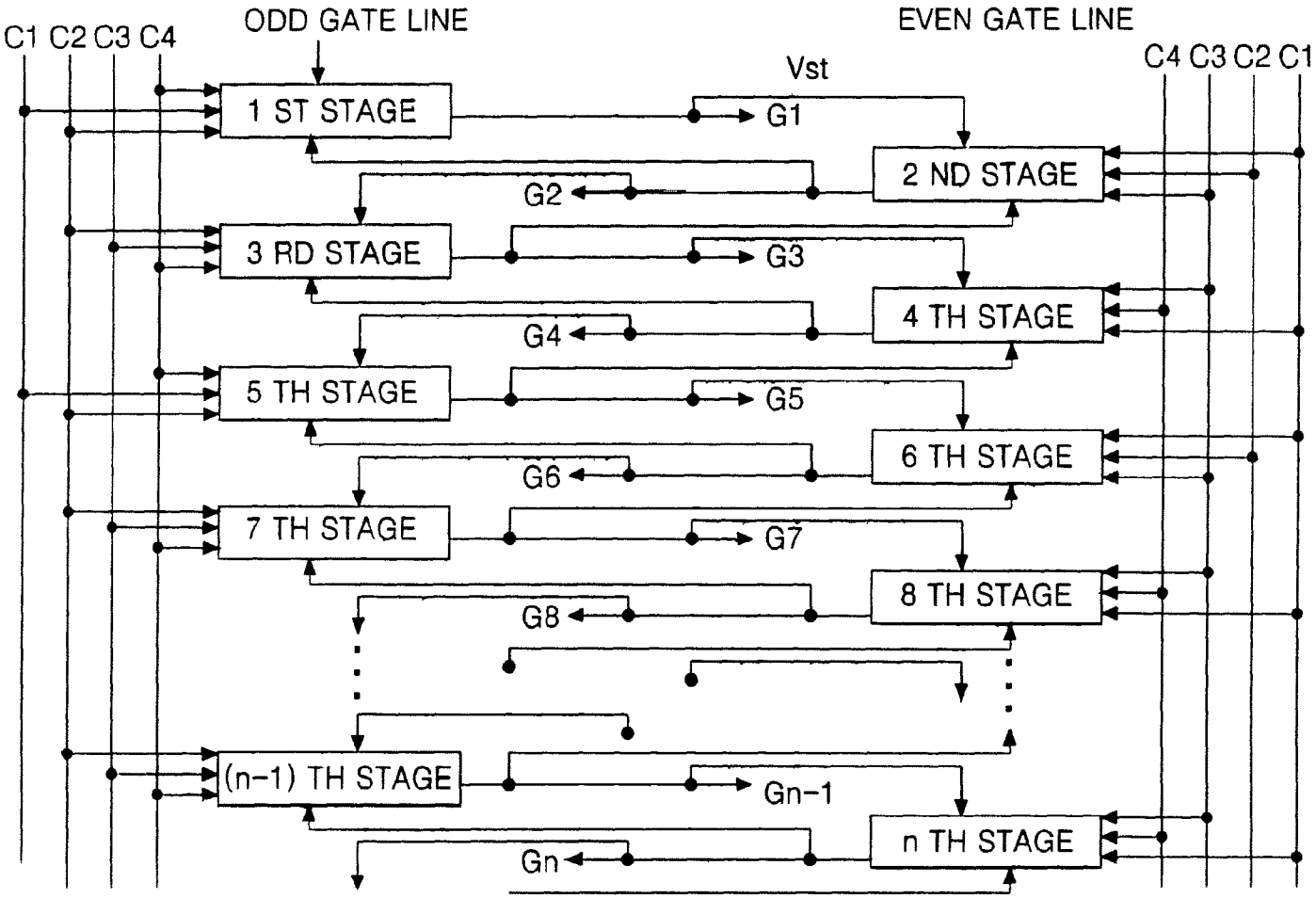
FIG. 18 is a view representing still another implement of the gate driving circuit shown in FIG. 9, using the circuit of FIG. 6.

On the other hand, FIG. 14 and FIG. 18 represent a method in which an output of a second terminal is used as a reset signal of a first terminal, an output of a third terminal is used as a reset signal of a second terminal, an output of a fourth terminal is used as a reset signal of a third terminal, and an output of a fifth terminal is used as a reset signal of a fourth terminal.

Figure 19:
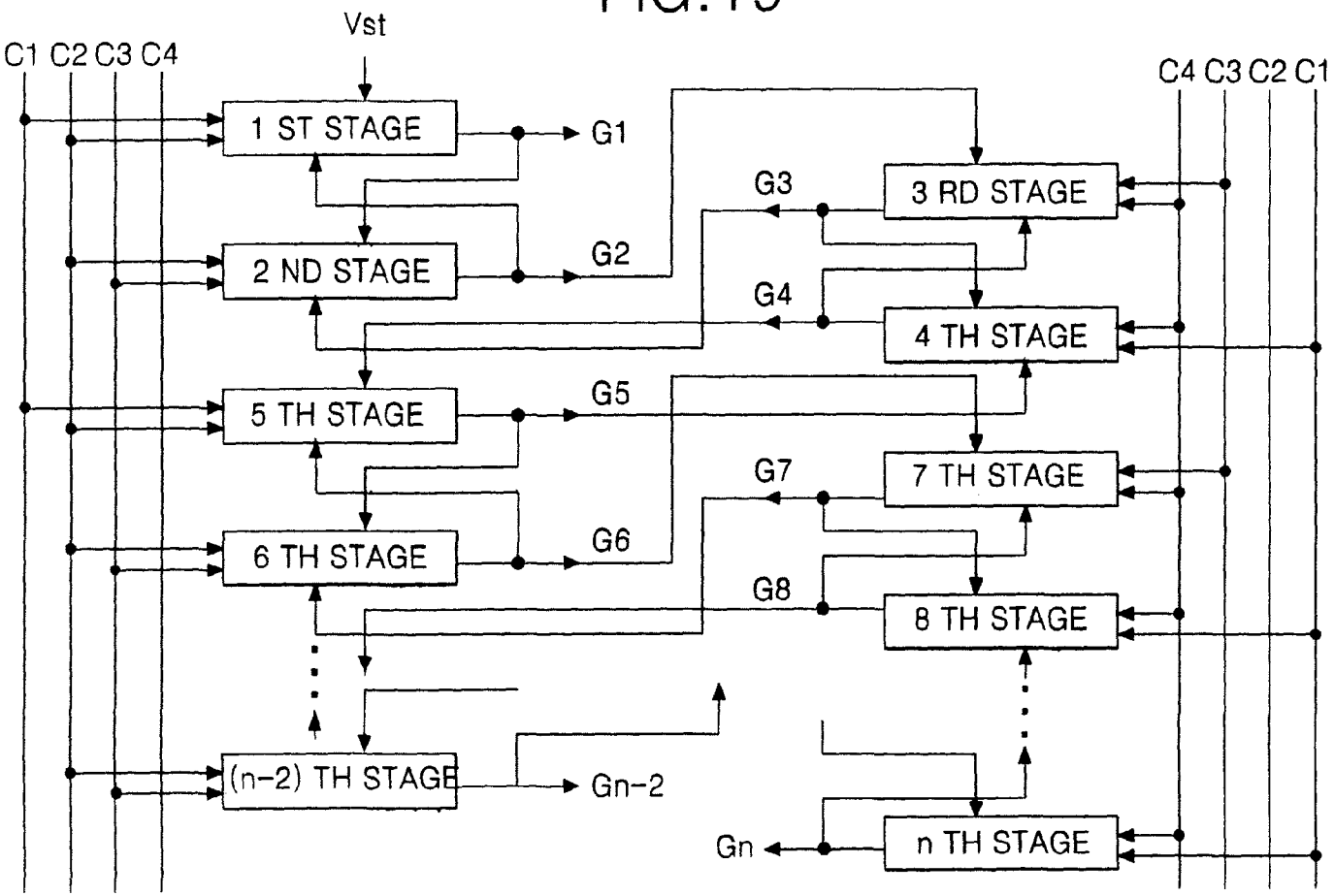
FIG. 19 is a view representing an implement of the gate driving circuit shown in FIG. 10, using the circuit of FIG. 4.
Figure 20:
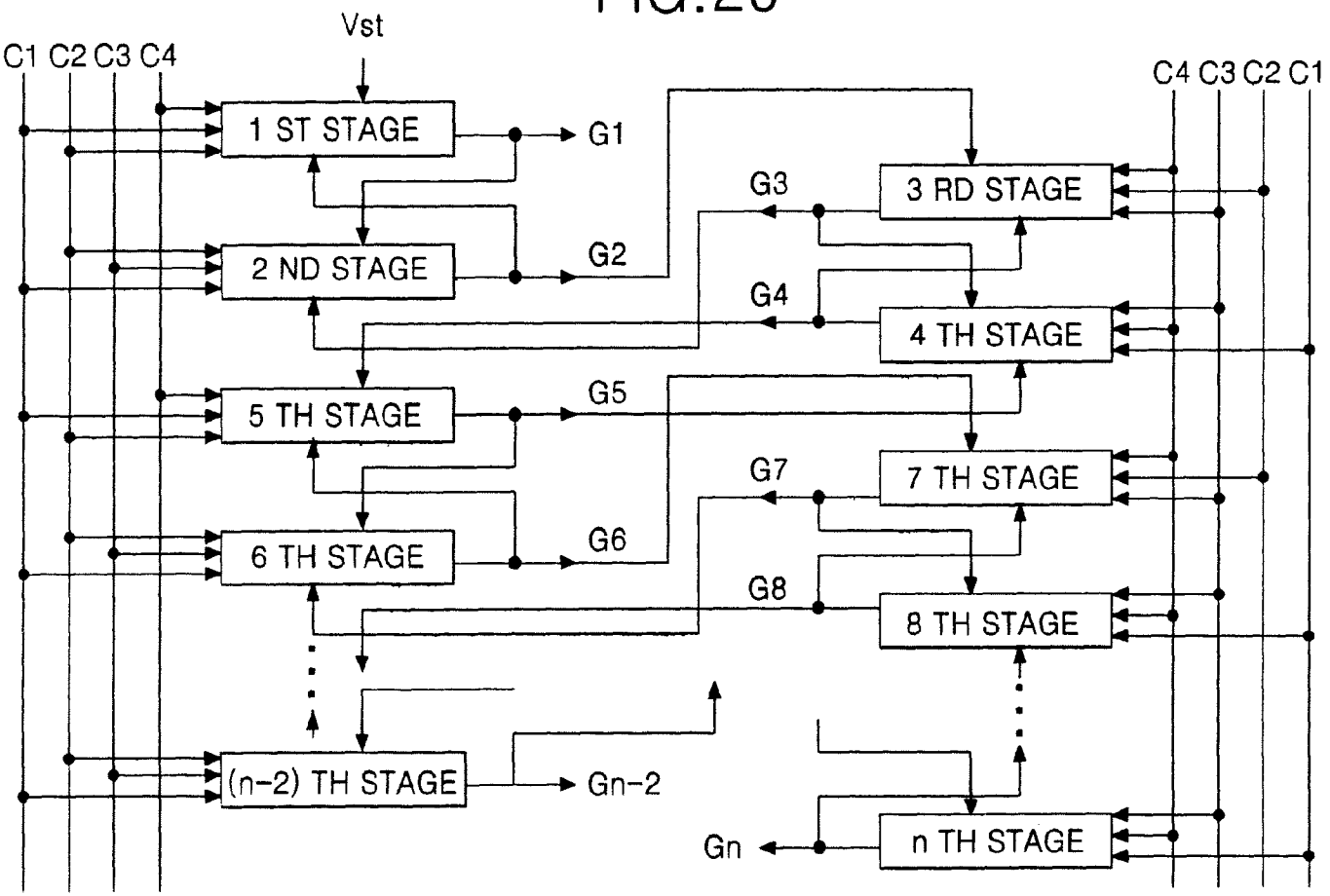
FIG. 20 is a view representing an implement of the gate driving circuit shown in FIG. 10, using the circuit of FIG. 6.

FIGS. 19 and 20 represent a stage configuration for implementing the system of FIG. 10. FIG. 19 represents a stage configuration using the circuit of FIG. 4, and FIG. 20 represents a stage configuration using the circuit of FIG. 6.

Referring to FIGS. 19 and 20, a first gate driving circuit includes a (4*s*−3)th stage and a (4*s*−2)th stage to drive a (4*s*−3)th gate line and a (4*s*−2)th gate line, and a second gate driving circuit includes a (4*s*−1)th stage and a (4*s*)th stage to drive a (4*s*−1)th gate line and a (4*s*)th gate line. To this end, each stage uses an output signal of a previous terminal as a start signal, and uses an output signal of the next terminal as a reset signal.

While the above-described system has been described with respect to an LCD device, it is applicable to other display devices such as organic light emitting diode (OLED) devices, plasma display panel (PDP) devices and field emissive display (FED) devices. The above-described system includes sub-pixels arranged in a 2×2 matrix representing red (R), green (G), blue (B) and white (W) colors to form one pixel. Also, a scan signal driving circuit supplying the scan signal to each sub-pixel may be formed on the same substrate and at the same time as the pixels and signal lines.

As described above, the display apparatus according to an exemplary embodiment of the present invention adds a white (W) color sub-pixel to sub-pixels implementing red (R), green (G) and blue (B) colors to thereby improve a brightness of a display panel. The display apparatus provides sub-pixels in a 2×2 quad matrix structure that each implement each of red (R), green (G), blue (B) and white (W) colors. The sub-pixels arranged in the 2×2 quad matrix structure form one pixel. The 2×2 quad matrix structure enables the reduction of the number of data lines to ⅓ as compared with a related art LCD device. Accordingly, the number of the data driving integrated circuits further becomes reduced. Accordingly, the cost of the data driving integrated circuits further becomes reduced. In addition, the pixel element and signal lines are formed without a separate additional process and a plurality of amorphous transistors are formed on a lower glass substrate by a chip on glass (COG) system to thereby implement a scan signal driving circuit. Accordingly, it is possible to simplify processing steps and to reduce the cost of the processes.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display apparatus comprising:

a plurality of scan signal lines and a plurality of data signal lines that cross each other;

a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix;

a first scan signal driving circuit including (2N−1)th stages that supplies the scan signal to odd-numbered scan signal lines among the scan signal lines, wherein N is a positive integer;

a second scan signal driving circuit including (2N)th stages that supplies the scan signal to even-numbered scan signal lines among the scan signal lines; and a data signal driving circuit that supplies the data signal to the data signal lines, wherein the first and the second scan signal driving circuits, the pixels, the scan signal lines and the data signal lines are formed on a same substrate, wherein an output signal of a first stage is inputted as a start signal of a third stage, an output signal of the third stage is inputted as a reset signal of the first stage, an output signal of a second stage is inputted as a start signal of a fourth stage, and an output signal of the fourth stage is inputted as a reset signal of the second stage, wherein each of the stages included in the first and the second scan signal driving circuits includes a pull-up transistor that charges any one of the gate lines by using a first clock signal in response to a voltage on a Q node, a pull-down transistor that discharges any one of the gate lines in response to a voltage on a QB node and a controller (C) that controls the Q node and the QB node, wherein the controller (C) charges the Q node in response to a start signal, discharges the Q node in response to the voltage on the QB node and an output signal of a next stage, discharges the QB node in response to the start signal, a second clock signal delayed by one clock interval from the first clock signal, and the voltage on the Q node, and charges the QB node in response to a fourth clock signal delayed by two clock intervals from the second clock signal, and wherein the controller includes:

a first transistor (1) that charges the Q node with a high electrical potential supply voltage in response to the start signal;

a second transistor (4*a*) that charges a first node with the high electrical potential supply voltage in response to the fourth clock signal;

a third transistor (4) that charges the QB node with the high electrical potential supply voltage in response to the voltage on the first node;

a fourth transistor (4*b*) that discharges the first node with a low electrical potential reference voltage in response to the second clock signal;

a fifth transistor (3) that discharges the Q node with the low electrical potential reference voltage in response to the voltage on the QB node;

a sixth transistor (5*i*) that discharges the QB node with the low electrical potential reference voltage in response to the second clock signal;

a seventh transistor (5) that discharges the first node with the low electrical potential reference voltage in response to the start signal;

an eighth transistor (4*c*) that discharges the first node with the low electrical potential reference voltage in response to the start signal;

a ninth transistor (5*a*) that discharges the QB node with the low electrical potential reference voltage in response to the voltage on the Q node; and a tenth transistor (3*a*) that discharges the Q node with the low electrical potential reference voltage in response to a next terminal output signal.

2. A display apparatus comprising:

a plurality of scan signal lines and a plurality of data signal lines that cross each other;

a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix;

a first scan signal driving circuit including (2N−1)th stages that supplies the scan signal to odd-numbered scan signal lines among the scan signal lines, wherein N is a positive integer;

a second scan signal driving circuit including (2N)th stages that supplies the scan signal to even-numbered scan signal lines among the scan signal lines; and a data signal driving circuit that supplies the data signal to the data signal lines, wherein the first and the second scan signal driving circuits, the pixels, the scan signal lines and the data signal lines are formed on a same substrate, wherein an output signal of a first stage is inputted as a start signal of a third stage, an output signal of the third stage is inputted as a reset signal of a second stage, and an output signal of the second stage is inputted as a reset signal of the first stage and at the same time inputted as a start signal of a fourth stage, wherein each of the stages included in the first and the second scan signal driving circuits includes a pull-up transistor that charges any one of the gate lines by using a first clock signal in response to a voltage on a Q node, a pull-down transistor that discharges any one of the gate lines in response to a voltage on a QB node and a controller (C) that controls the Q node and the QB node, wherein the controller (C) charges the Q node in response to a start signal, discharges the Q node in response to the voltage on the QB node and an output signal of a next stage, discharges the QB node in response to the start signal, a second clock signal delayed by one clock interval from the first clock signal, and the voltage on the Q node, and charges the QB node in response to a fourth clock signal delayed by two clock intervals from the second clock signal, and wherein the controller includes:

a first transistor (1) that charges the Q node with a high electrical potential supply voltage in response to the start signal;

a second transistor (4*a*) that charges a first node with the high electrical potential supply voltage in response to the fourth clock signal;

a third transistor (4) that charges the QB node with the high electrical potential supply voltage in response to the voltage on the first node;

a fourth transistor (4*b*) that discharges the first node with a low electrical potential reference voltage in response to the second clock signal;

a fifth transistor (3) that discharges the Q node with the low electrical potential reference voltage in response to the voltage on the QB node;

a sixth transistor (5*i*) that discharges the QB node with the low electrical potential reference voltage in response to the second clock signal;

a seventh transistor (5) that discharges the first node with the low electrical potential reference voltage in response to the start signal;

an eighth transistor (4*c*) that discharges the first node with the low electrical potential reference voltage in response to the start signal;

a ninth transistor (5*a*) that discharges the QB node with the low electrical potential reference voltage in response to the voltage on the Q node; and a tenth transistor (3*a*) that discharges the Q node with the low electrical potential reference voltage in response to a next terminal output signal.

3. A display apparatus comprising:

a plurality of scan signal lines and a plurality of data signal lines that cross each other;

a plurality of pixels formed at each crossing of the scan signal lines and the data signal lines, wherein each of the pixels includes sub-pixels that display red color, green color, blue color and white color in response to a scan signal from the scan signal lines and a data signal from the data signal lines, wherein the sub-pixels are arranged in a 2×2 matrix;

a first scan signal driving circuit including (2N−1)th stages that supplies the scan signal to odd-numbered scan signal lines among the scan signal lines, wherein N is a positive integer;

a second scan signal driving circuit including (2N)th stages that supplies the scan signal to even-numbered scan signal lines among the scan signal lines; and a data signal driving circuit that supplies the data signal to the data signal lines, wherein the first and the second scan signal driving circuits, the pixels, the scan signal lines and the data signal lines are formed on a same substrate, wherein an output signal of a first stage is inputted as a start signal of a second stage, an output signal of the second stage is inputted as a reset signal of the first stage and at the same time as a start signal of a third stage, and an output signal of the third stage is inputted as a start signal of a fourth stage at the same time as a reset signal of the second stage, wherein each of the stages included in the first and the second scan signal driving circuits includes a pull-up transistor that charges any one of the gate lines by using a first clock signal in response to a voltage on a Q node, a pull-down transistor that discharges any one of the gate lines in response to a voltage on a QB node and a controller (C) that controls the Q node and the QB node, wherein the controller (C) charges the Q node in response to a start signal, discharges the Q node in response to the voltage on the QB node and an output signal of a next stage, discharges the QB node in response to the start signal, a second clock signal delayed by one clock interval from the first clock signal, and the voltage on the Q node, and charges the QB node in response to a fourth clock signal delayed by two clock intervals from the second clock signal, and wherein the controller includes:

a first transistor (1) that charges the Q node with a high electrical potential supply voltage in response to the start signal;

a second transistor (4*a*) that charges a first node with the high electrical potential supply voltage in response to the fourth clock signal;

a third transistor (4) that charges the QB node with the high electrical potential supply voltage in response to the voltage on the first node;

a fourth transistor (4*b*) that discharges the first node with a low electrical potential reference voltage in response to the second clock signal;

a fifth transistor (3) that discharges the Q node with the low electrical potential reference voltage in response to the voltage on the QB node;

a sixth transistor (5*i*) that discharges the QB node with the low electrical potential reference voltage in response to the second clock signal;

a seventh transistor (5) that discharges the first node with the low electrical potential reference voltage in response to the start signal;

an eighth transistor (4*c*) that discharges the first node with the low electrical potential reference voltage in response to the start signal;

a ninth transistor (5*a*) that discharges the QB node with the low electrical potential reference voltage in response to the voltage on the Q node; and a tenth transistor (3*a*) that discharges the Q node with the low electrical potential reference voltage in response to a next terminal output signal.

* * * * *